US007292128B2

(12) United States Patent
Hanley

(10) Patent No.: US 7,292,128 B2
(45) Date of Patent: Nov. 6, 2007

(54) GAPPED CORE STRUCTURE FOR MAGNETIC COMPONENTS

(75) Inventor: Renford LaGuardia Hanley, Wellington, FL (US)

(73) Assignee: Cooper Technologies Company, Houston, TX (US)

( * ) Notice: Subject to any disclaimer, the term of this patent is extended or adjusted under 35 U.S.C. 154(b) by 82 days.

(21) Appl. No.: 11/354,746

(22) Filed: Feb. 15, 2006

(65) Prior Publication Data

US 2006/0192646 A1 Aug. 31, 2006

Related U.S. Application Data

(63) Continuation-in-part of application No. 10/736,059, filed on Dec. 15, 2003.

(60) Provisional application No. 60/435,414, filed on Dec. 19, 2002.

(51) Int. Cl.
*H01F 27/24* (2006.01)
*H01F 17/06* (2006.01)

(52) U.S. Cl. ..... 336/234; 336/178

(58) Field of Classification Search ..... 336/200, 336/178, 234, 212

See application file for complete search history.

(56) References Cited

U.S. PATENT DOCUMENTS 5,861,792 A * 1/1999 Ueda et al. ..... 336/234
5,999,078 A * 12/1999 Herbert ..... 336/172
6,433,664 B1 * 8/2002 Ishii et al. ..... 336/185

FOREIGN PATENT DOCUMENTS

JP 04042513 A * 2/1992

* cited by examiner

*Primary Examiner*—Anh Mai
(74) *Attorney, Agent, or Firm*—King & Spalding LLP

(57) ABSTRACT

A single piece core structure for magnetic components that is formed without utilizing insulating spacer materials and bonding materials.

32 Claims, 6 Drawing Sheets

GAPPED CORE STRUCTURE FOR MAGNETIC COMPONENTS

CROSS REFERENCE TO RELATED APPLICATIONS

This application is a continuation-in-part application of U.S. patent application Ser. No. 10/736,059 filed Dec. 15, 2003, that claims the benefit of U.S. Provisional application Ser. No. 60/435,414 filed Dec. 19, 2002, the disclosures of which are hereby incorporated by reference in their entirety.

BACKGROUND OF THE INVENTION

This invention relates generally to the manufacture of electronic components, and more specifically to manufacturing of magnetic components such as inductors.

A variety of magnetic components, including but not limited to inductors and transformers, include at least one winding disposed about a magnetic core. In some components, a core assembly is fabricated from ferrite cores that are gapped and bonded together. In use, the gap between the cores is required to store energy in the core, and the gap affects magnetic characteristics, including but not limited to open circuit inductance and DC bias characteristics. Especially in miniature components, production of a uniform gap between the cores is important to the consistent manufacture of reliable, high quality magnetic components.

In some instances, epoxies have been used to bond the ferrite cores used to produce the bonded core assembly for magnetic components. In an effort to consistently gap the cores, non-magnetic beads, typically glass spheres, are sometimes mixed with adhesive insulator materials and dispensed between the cores to form the gap. When heat cured, the epoxy bonds the cores and the beads space the cores apart to form the gap. The bond, however, is primarily dependant upon the viscosity of the epoxy and the epoxy to beads ratio of the adhesive mix dispensed between the cores. It has been noted that in some applications the bonded cores are insufficiently bonded for their intended use, and controlling the epoxy to glass spheres ratio in the adhesive mix has proven very difficult.

In another type of magnetic component, a non-magnetic spacer material is placed between two magnetic core halves, and the core halves are then fastened together to hold the spacer material in place. The spacer material is frequently made of a paper or mylar insulator material. Typically, the core halves and spacer are secured to one another with tape wrapped around the outside of the core halves, with an adhesive to secure the core halves together, or with a clamp to secure the core halves and keep the gap located between the core halves. Multiple (more than two) pieces of spacer material are rarely used, since the problem of securing the structure together becomes very complicated, difficult and costly.

Still another type of magnetic component includes a gap ground into one section of a core half, and remaining sections of the core half are fastened to another core half with any of the foregoing techniques.

Yet another method of creating a gap in core structures begins with a single piece core, and a slice of material is cut from the core (typically a toroid shaped core). The gap is frequently filled with an adhesive or epoxy to restore the strength and shape of the core.

Recently, composite magnetic ceramic toroids have been developed that include layered magnetic constructions separated by a nonmagnetic layer to form a gap. See, for example, U.S. Pat. No. 6,162,311. Bonding material (e.g., adhesives) and external gapping material (e.g. spacers) for magnetic core structures may therefore be eliminated.

In any of the foregoing devices, a conductor is typically placed through the core to couple energy into the core in the form of magnetic flux, and magnetic flux lines cross through and around the gap to complete a magnetic path in the core. If the conductor intersects the flux lines, a circulating current is induced in the conductor. Resistance of the conductor creates heat as the current circulates, which reduces the efficiency of the magnetic component. Moving the conductor farther away from the magnetic flux lines can reduce the amount of energy that is coupled to the conductor and hence increase the efficiency of the component, but this typically entails increasing the size of the component, which is undesirable from a manufacturing perspective.

Also, known magnetic components are typically assembled on a single core structure. When multiple inductors are employed, for example, the cores must be physically separated to prevent interference with one another in operation. Separation of the components occupies valuable space on a printed circuit board.

It is therefore desirable to provide a magnetic component of increased efficiency and improved manufacturability for circuit board applications without increasing the size of the components and occupying an undue amount of space on a printed circuit board.

DETAILED DESCRIPTION OF THE INVENTION

Figure 1:
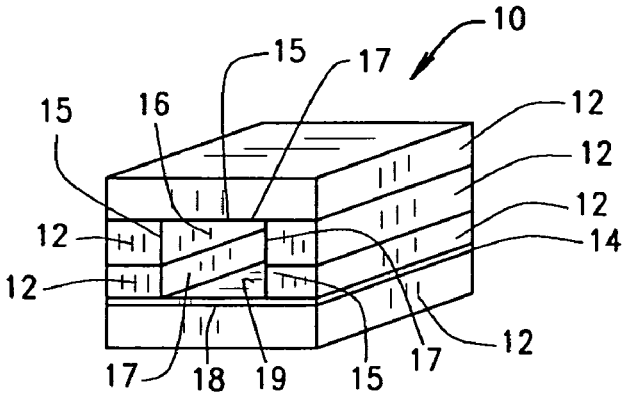
FIG. 1 is a perspective view of an exemplary gapped core structure for fabricating a magnetic component.

FIG. 1 is a perspective view of an exemplary gapped magnetic core structure 10 for magnetic components such as inductors, transformers, and other magnetic components including a gapped core structure. The core structure 10 includes a number of magnetic layers 12 in a stacked configuration, with a non-magnetic layer 14 extending between and separating two of the magnetic layers 12 to form an integrated gap therein to interrupt a magnetic path through the core structure 10.

As illustrated in FIG. 1, the core structure 10 is suited for forming a single magnetic component, such as, for example, an inductor. The core structure 10 is constructed by combining layers of green (unfired) magnetic ceramic material forming the magnetic layers 12, and a layer of a green non-magnetic ceramic core material forming the non-magnetic layer 14. The magnetic ceramic material provides the magnetic core, while the non-magnetic ceramic material functions as the gap.

A section of the layered ceramic materials of core structure 10 is removed to create an area or opening 16 therethrough for a conductor element (not shown in FIG. 1). In the illustrated embodiment, the opening 16 is substantially rectangular and is defined by peripheral edges 15 of the magnetic layers 12 and a peripheral edge 18 of the nonmagnetic layer 14. Side surfaces 17 extend from the edges 15 of the magnetic layers 14 and a top surface 19 extends from the edge 18 of the nonmagnetic layer 14 to form an interior bore through the core structure 10. In another embodiment, the opening 16 and/or the bore may be fabricated into another shaped in lieu of the rectangular shape illustrated in FIG. 3.

Once the magnetic and nonmagnetic layers 12, 14 are stacked to an appropriate thickness and bonded together, such as with a known lamination process, the opening 16 is formed according to known techniques, such as a known punching process. The core structure 10 then is fired to develop the final shape and properties of the core structure. A gapped magnetic core 10 is therefore fabricated as a monolithic structure The gap size can be tightly controlled over large production lot sizes, providing a tightly controlled inductance value.

The monolithic structure of magnetic core structure 10 provides a number of manufacturing advantages For example, adhesive bonding and external gapping materials, together with associated expenses and difficulties, are eliminated and the monolithic structure is consequently less subject to separation. The integrated gap structure also allows for very tightly controlled inductance values, and multiple small gaps (instead of one to two larger gaps in conventional core structures) may be employed to reduce flux losses and heat losses in the conductor materials placed into the core in use. Moreover, introduction of the gap requires no machining operations. The resulting magnetic component including the core structure 10 is therefore robust and tight control of the gap width can be maintained.

A wide range of ferrite materials can be used as the magnetic medium to form magnetic layers 12 in the core structure 10. Exemplary ferrite materials include manganese zinc ferrite, and particularly power ferrites, nickel zinc ferrites, lithium zinc ferrites, magnesium manganese ferrites, and the like that have been commercially used and are rather widely available. For non-magnetic layers 14, a wide range of ceramics materials may be employed, including for example alumina, alumina glass mixtures, cordierite, cordierite glass mixtures, mullite, mullite glass mixtures, zirconia, zirconia glass mixtures, barium titanate, and other titanates, steatite, mixtures of ferrite and non-magnetic ceramics, and like non-magnetic or weakly magnetic ceramic materials which can be co-fired with ferrite materials. The addition of a glassy phase to the non-magnetic ceramics allows for modification of their sintering temperature and firing shrinkage. This is important as the non-magnetic ceramic must closely match the thermal properties of the magnetic phase, i.e., the ferrite. If the firing shrinkage of the two materials is not fairly well matched, the component may not operate satisfactorily.

While the embodiment illustrated in FIG. 1 includes three magnetic layers 12 and one non-magnetic layer 14, it is contemplated that greater or fewer magnetic layers 12 could be employed with greater or fewer non-magnetic layers 14 in alternative embodiments without departing from the scope of the present invention. Further, while the core structure 10 is illustrated as a substantially rectangular structure in FIG. 1, it is appreciated that other shapes for core structure 10 may be employed in alternative embodiments, including but not limited to toroid shapes known in the art.

The type of ferrite used in magnetic layers 12 and the thickness of non-magnetic layers 14 effects the magnetic properties of core structure 10, and ultimately the properties of the resultant magnetic component in which it is used. Power loss density, for example, can be varied by altering the starting ferrite composition, which in the case of a switching voltage regulator component is particularly advantageous to reduce power losses. The effective permeability, another important property, is controlled in large part by the thickness of the non-magnetic layer 14.

Figure 2:
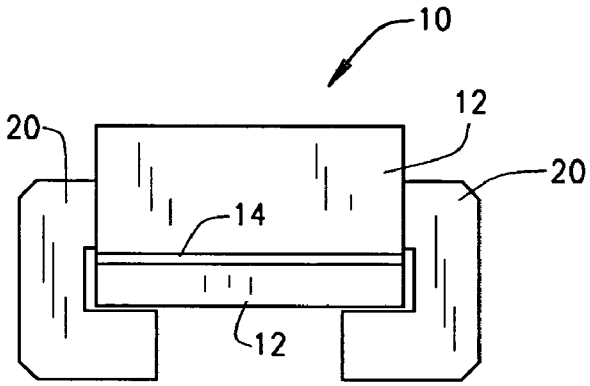
FIG. 2 is side elevational view of the core structure shown in FIG. 1 fitted with a conductor.

FIG. 2 is side elevational view of core structure 10 fitted with a conductor element 20. In an exemplary embodiment, the conductor element 20 is fabricated from a known conductive material and is formed or bent on respective ends thereof after being passed through the conductor opening 16 (shown in FIG. 1). In the illustrative embodiment of FIG. 2, the core structure 10 and conductor element 20 are well suited to form an inductor. Assembly of the core structure 10 and conductor element 20 can easily be automated as desired. Multiple conductor elements 20 may be inserted into core structures 10 as a single lead frame, then formed and trimmed to the finished product. High volume magnetic components may therefore be efficiently manufactured at comparably lower costs than, for example, known inductors.

Figure 3:
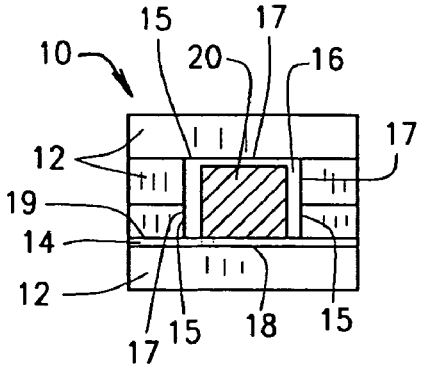
FIG. 3 is a cross sectional schematic view of the core structure and conductor shown in FIG. 2.

FIG. 3 is a cross sectional schematic view of the core structure 10 and conductor element 20 illustrating the conductor element 20 in contact with and supported by the non-magnetic layer 14 and otherwise substantially centered with respect to the conductor opening 16. That is, the conductor element 20 abuts the top surface 19 of the nonmagnetic material 14 but is spaced from the side edges 15 of the magnetic material 12 by an approximately equal distance within the opening 16. As such, a nonmagnetic gap extends directly beneath the conductor element 20 and the conductor element 20 is spaced from the inner surfaces 17 of the opening 16.

As illustrated in an exemplary embodiment in FIG. 3, the conductor element 20 is complementary in shape to conductor opening 16, and hence in one embodiment each of them are substantially rectangular in cross section. It is appreciated, however, that other cross sectional shapes of the conductor element 20 and the conductor opening 16 may be employed in alternative embodiments of the invention while achieving at least some of the benefits of the invention. In a further embodiment, it is noted that the conductor element 20 and the conductor opening 16 need not have complementary shapes to achieve the instant benefits of the invention.

Furthermore, while the conductor element 20 illustrated in FIG. 2 is shown as being inserted through the core structure 10, it is contemplated that a conductive material could alternatively be plated on a surface of the core structure 10, or, alternatively, a conductive material could be printed on the core structure 10 utilizing, for example, a known conductive ink such as those used in thick film processes.

Figure 4:
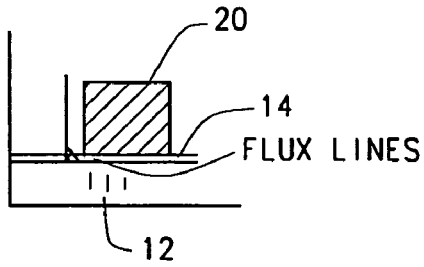
FIG. 4 is a cross sectional schematic of a portion of FIG. 3 illustrating magnetic flux lines of the core structure.

FIG. 4 schematically illustrates magnetic flux lines of the core structure 10 in use, and in particular it is noted that the conductor element 20 does not intersect the flux lines. Thus, induced current in the conductor element 20 is reduced, associated heat losses are avoided, and efficiency of the magnetic component is increased. Increased component efficiency is therefore obtained with a compact component size.

As those in the art may appreciate, the component efficiency is of most concern at higher switching frequencies. The above-described structure, with a single turn conductor element 20, is therefore particularly suited for higher frequency applications. It is appreciated however that conductive elements having multiple turns may likewise be employed in alternative embodiments of the invention.

Figure 5:
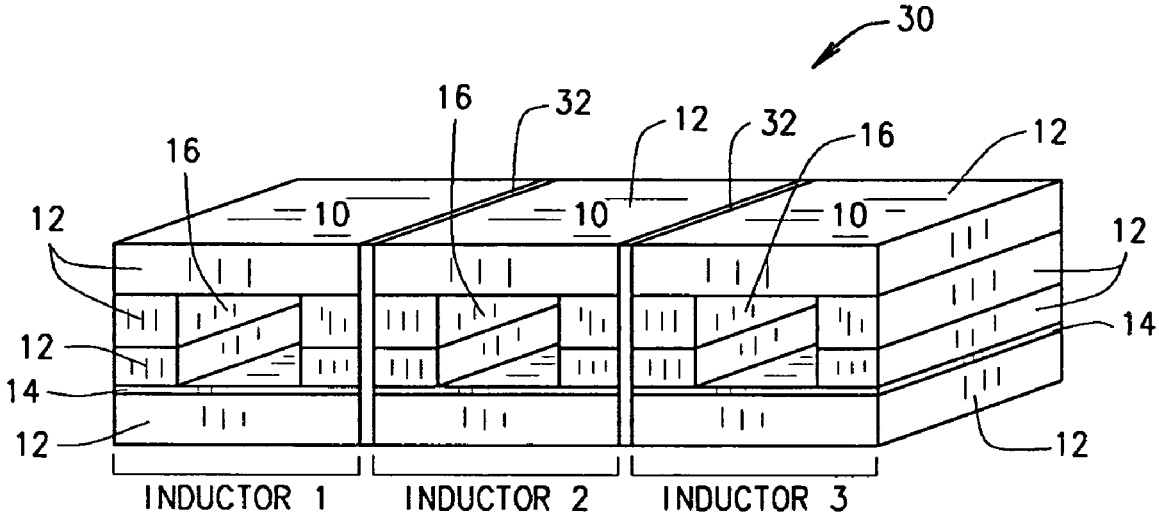
FIG. 5 is a second exemplary embodiment of a gapped core structure.

FIG. 5 is a second embodiment of a gapped core structure 30 illustrating a multiple gapped core structure. Stacking layers 12, 14 of magnetic and non-magnetic materials as described above into a single structure can create multiple magnetic components, as described above, on a singular or unitary core structure 30. Thus, two, three or more magnetic components such as inductors, for example, can be built into one core structure 30, such as that illustrated in FIG. 5 when conductive elements, such as the conductor element 20 (shown in FIGS. 2 and 3) are placed through openings 16, or when conductive elements are otherwise formed on surfaces of the core structure 30.

Utilizing a unitary integrated core structure 30 for multiple magnetic components results in lower costs since packaging and handling of a single part is lower than the cost of handling many parts. Overall system costs can also be reduced, since placement of less parts should result in a cost savings. Yet another benefit is that the core structure 30 utilizes a reduced area on a circuit board in comparison to individual magnetic components (such as the single inductor shown in FIGS. 2 and 3) in combination. Multiple inductors integrated into the single core structure 30 occupy less room than a comparable number of individual components and cores, largely because physical clearances required of individual components is not an issue with the integrated core structure 30.

As illustrated in FIG. 5, the core structure 30 is fabricated from a series of stacked magnetic layers 12 divided by at least one non-magnetic layer 14. The magnetic layers 12 extend horizontally and are stacked vertically, and a number of conductor openings 16 are formed into the stacked magnetic and nonmagnetic layers 12, 14. The conductor openings 16 are separated by a vertically extending non-magnetic or insulating layer 32, and the vertically extending insulating layers 32 bond the vertically stacked magnetic and nonmagnetic layers 12, 14 in which each conductor opening 16 resides. Thus, the core structure 30 may be recognized as a plurality of core structures 10 (shown in FIGS. 1-4) attached to one another in a side-by-side configuration to form a larger core structure 30. The vertically extending insulating layers 32 may be bonded between stacked layers 12, 14 either before or after the openings 16 are formed, and the core structure 30 is fired as a monolithic structure into its final form.

Once completed, the conductor openings 16 are fitted with conductive elements, such as the conductor elements 20 described above, to form a plurality of magnetic components operable from the same monolithic core structure. This results in an overall less costly solution than using separate components, such as inductors, especially when automatic component placement equipment is used. The combined inductor structure on core 30 will use less space on a circuit board than multiple individual inductors since physical interference or "keep-out" areas are no longer required. Additionally, use of a single magnetic core structure 30 for multiple conductor elements allows inductance values to track one another, since the heating of individual inductors affects the other inductors on the same structure similarly.

The core structure 30 is particularly suited for a multiple voltage regulator module (VRM) that is frequently used in high performance, higher current applications. Total current delivered to the load in a VRM is the sum of each VRM section. Since many inductors can be used in a voltage regulator circuit, it is advantageous to combine more than one inductor into a single package as facilitated by the core structure 30.

While stacked layers 12, 14 of core structure 30 includes four magnetic layers 12 and one non-magnetic layer 14, it is appreciated that more than one non-magnetic layer 14 may be employed with greater or fewer magnetic layers 12 without departing from the scope of the present invention. Further, as noted above with respect to the core 10, the core structure 30 need not have a rectangular shape and need not have rectangular conductor openings to achieve the instant benefits of the invention, and hence in different embodiments a variety of shapes for overall core structure 30 and/or the conductor openings 16 may be employed.

Figure 6:
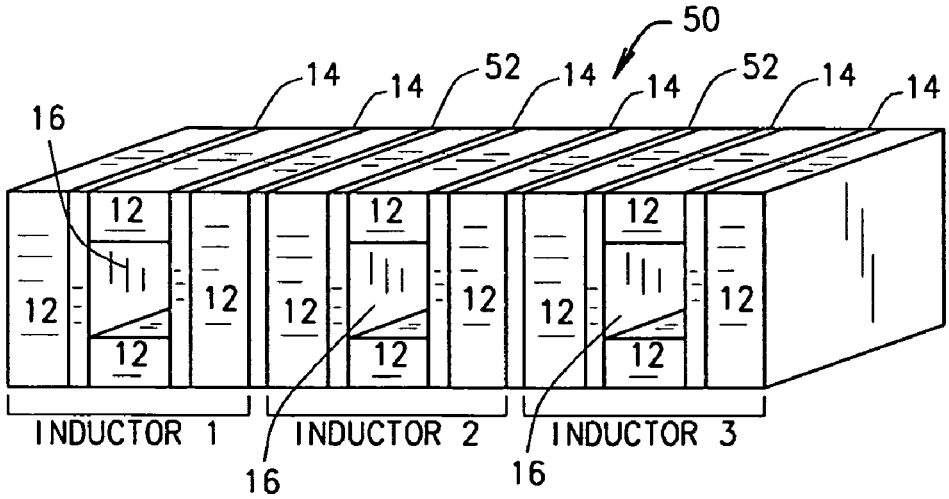
FIG. 6 is a third embodiment of an exemplary core structure.

FIG. 6 is a third embodiment of an exemplary core structure 50 wherein a number of core structures are stacked one above the next and separated by a non-magnetic insulating layer 52. In the illustrated embodiment, each core structure includes two non-magnetic layers 14 sandwiched between magnetic layers 12, and insulating layers 52 extend between each cores structure and are substantially parallel to the layers 12, 14 of each core structure The nonmagnetic layers 14 define opposite sides of the conductor openings 16. The insulating layers 52 may be bonded between stacked layers 12, 14 either before or after openings 16 are formed, and core structure 50 is fired as a monolithic structure into its final form.

While stacked layers 12, 14 of core structure 50 includes three magnetic layers 12 and two non-magnetic layers 14, it is appreciated that greater or fewer numbers of—magnetic layers 14 may be employed with greater or fewer cumber of magnetic layers 12 without departing from the scope of the present invention. Further, as noted above with respect to the core structure 30, the core structure 50 need not have an overall rectangular shape and need not have rectangular conductor openings to achieve the instant benefits of the invention, and hence in different embodiments a variety of shapes for overall core structure 30 and/or the conductor openings 16 may be employed.

While the embodiments illustrated embodiments are structured to include three magnetic components in a unitary core structure, it is contemplated that greater or fewer than three magnetic components or circuits could be combined into a single structure in further and/or alternative embodiments.

Structural differences aside, the core structure 50 provides approximately the same advantages as core structure 30 (shown in FIG. 5).

A gapped core structure for producing magnetic components, such as inductors, transformers, or other components is therefore provided. Bonding and external gapping material used in conventional core structures are avoided, and electrical efficiency is improved by the use of multiple small gaps (instead of one to two larger gaps) to reduce fringing flux losses in the conductor materials, and the structure allows for very tightly controlled inductance values. The gaps are placed such that the fringing flux can be placed away from the conductor, resulting in maximum efficiency, and multiple inductors may be assembled onto a single core structure, reducing overall cost and size.

Figure 7:
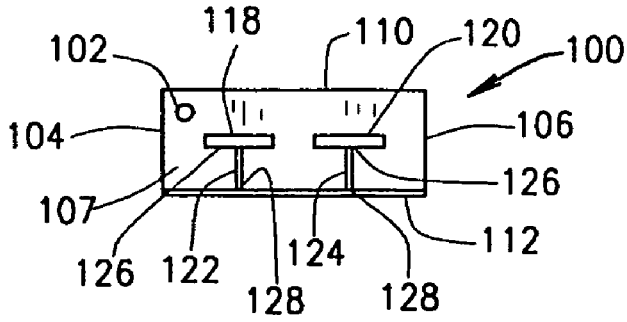
FIG. 7 is a side view of a fourth embodiment of a gapped core structure.
Figure 8:
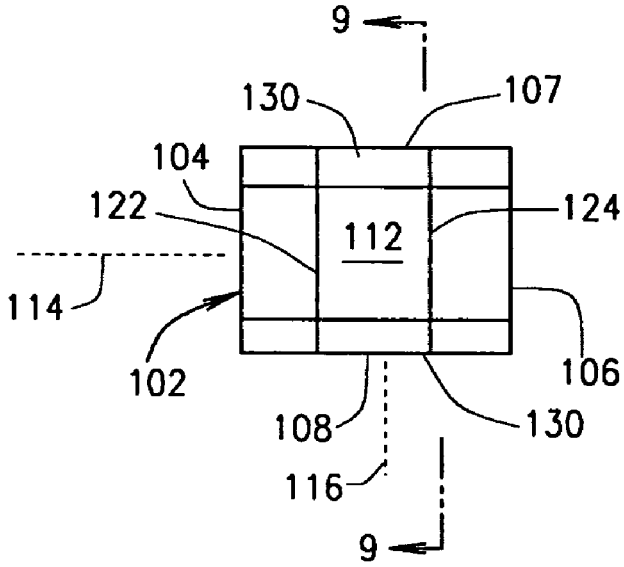
FIG. 8 is a bottom view of the core shown in FIG. 7.
Figure 9:
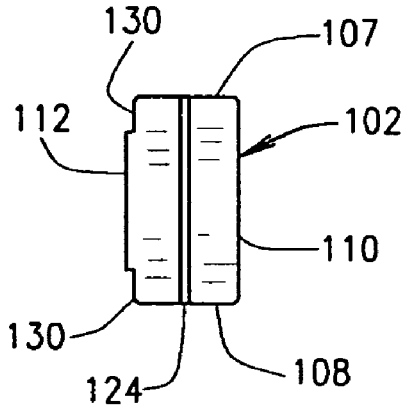
FIG. 9 is a cross sectional view of the core shown in FIG. 8.

FIGS. 7-9 illustrate another embodiment of a gapped core structure 100 for magnetic components such as inductors, transformers, and other magnetic components including a gapped core structure, while providing similar benefits to the structures 30 and 50 described above. Like the structures 30 and 50, the gapped core structure 100 entirely avoids external gapping materials and associated bonding materials and adhesives typically employed in conventional gapped core structures for surface mount components for circuit board applications. Reliability issues associated with separation of multiple core pieces bonded together, to which conventional bonded core structures are susceptible, is therefore avoided. Additionally, manufacturing of the core structure 100 is simplified compared to conventional core structures, and space savings may be realized when the gapped core structure 100 is mounted to a circuit board.

FIG. 7 is a side view the gapped core structure 100, and FIGS. 8 and 9 are a bottom view and a cross sectional view, respectively, of the gapped core structure 100. Referring now to FIGS. 7-9, the core structure 100 may include a substantially rectangular body 102 having opposed end faces 104 and 106, opposed side edges 107 and 108 extending between the end faces 104 and 106, and top and bottom surfaces 110 and 112 extending between and interconnecting the end faces 104 and 106 and the side edges 107 and 108. The body 102 may be elongated and defined by a longitudinal axis 114 and a lateral axis 116. As illustrated in the Figures, the side edges 107 and 108, and also the top and bottom surfaces 110 and 112, extend parallel to the longitudinal axis 114, and the end faces 104 and 106 extend generally parallel to the lateral axis 116. While an exemplary rectangular shape of the body 102 is illustrated, it is understood that in other embodiments other alternative shapes of the body 102 could be utilized if desired.

The body 102 may be formed in a single piece and fabricated from a known magnetic medium or material, including any of the ferrite materials mentioned above in an exemplary embodiment. Known processes or techniques may be utilized to fabricate the body 102. Notably, and unlike the core structures 30 and 50 described above, the core structure 100 does not include non-magnetic materials, such as the non-magnetic layers 14 and 32 described above, in the construction of the core structure 100. That is, instead of being monolithically formed from dissimilar materials in the manner described above in relation to the core structures 30 and 50, the body 102 of the core structure is fabricated from a uniformly magnetic material, without intervening pieces or segments of non-magnetic or insulating material, into a single monolithic piece having relatively constant magnetic properties throughout the body 102. Additionally, and in one exemplary embodiment, the body 102 is fabricated entirely from magnetic material, as opposed to composite materials such as so-called distributed air gap core materials having, for example, a powdered iron and resin binder mixed with one another on a particle level, thereby producing a gap effect without formation of a discrete gap in the structure. In other embodiments, however, composite materials may be used if desired.

Conductor openings 118, 120 (FIG. 7) may be formed in the body 102, and the openings 118, 120 may extend entirely through the body 102 between the side edges 107 and 108 as best seen in FIG. 9. Each of the openings 118, 120 is spaced from and located between the side edges 107, 108 and the top and bottom surfaces 110, 112 on each the side edges 107 and 108. The conductor openings 118, 120 each extend generally normal or perpendicular to the end edges 107 and 108, and are each located at a spaced relation from the outer periphery of the end edges 107, 108, defined in the illustrated embodiment by the top and bottom surface 110 and 112 and the end edges 107 and 108. That is, the conductor openings 118, 120 are each located at an internal location with respect to the outer periphery of the side edges 107 and 108.

The conductor openings 118 and 120 may be for example, rectangular openings that are elongated in a direction parallel to the longitudinal axis 114, although other shapes of openings may be utilized in other embodiments. The openings 118, 120 may be formed integrally into the body 102 according to known methods, including but not limited to molding and/or machining techniques familiar to those in the art. While two openings 118, 120 are illustrated in FIGS. 7-9, it is understood that greater or fewer numbers of openings 118 and 120 could be provided in alternative embodiments.

Discrete non-magnetic gaps 122, 124 may also be integrally formed in the body 102, and each of the gaps 122, 124 may be associated with one of the conductor openings 118, 120. The gaps 122, 124 are physically formed, for example, into the body 102 via known molding and/or machining techniques. Notably, external gapping materials and associated bonding materials and adhesives are not used to form the gaps 122, 124 in any manner whatsoever, and the gaps 122, 124 are devoid of any filler material other than air. That is, the gaps 122, 124 are formed without using insulator materials, sometimes referred to as external gapping materials, applied to the body in an exemplary embodiment. It is understood, however, that in an alternative embodiment the gaps 122, 124 may optionally be filled with a non-magnetic material while still achieving some of the benefits of the present invention.

In an exemplary embodiment, and as best shown in FIG. 7, the gaps 122, 124 may extend transversely to the respective conductor openings 118, 120. For example, each of the gaps 122, 124 may have opposite ends 126 and 128. One end 126 terminates at the respective conductor opening 118, 120 and opens to the respective conductor opening 118, 120, thereby placing the end 126 of the gaps 122, 124 in fluid communication with the respective conductor openings 118 and 120. The opposite end 128 of each gap 122, 124 extends to the periphery of the side edges 107, 108 and more particularly to the bottom surface 112. Each gap 122, 124 generally bisects the conductor openings 122, 124 and extends normally or perpendicular to the conductor openings 122, 124, thereby imparting a T-shaped configuration to the gaps 122, 124 and conductor openings 118, 120 when viewed from the side.

The gaps 122, 124 extend entirely from one side edge 107 to the other side edge 108 in a direction parallel to the lateral axis 116 as shown in FIG. 8. That is, the gaps 122, 124 extend entirely across and through the body 102 in a horizontal direction extending between the side edges 107 and 108. However, the gaps 122, 124 may extend in a vertical direction, extending between the top and bottom surfaces 110, 112, on only one side of the conductor openings 118, 120, and more specifically may extend between the conductor openings 118, 120 and the bottom surface 112 in the illustrative embodiment of FIG. 7. Notably, the gaps 122, 124 do not extend between the conductor openings 118, 120 and the top surface 110 of the body 102. As such, the gaps 122, 124 extend incompletely between the top and bottom surfaces 110, 112 of the body 102. Incomplete extension of the gaps 122, 124 is specifically contrasted to core structures having core halves that are bonded to one another with a gap material extending therebetween across the entirety of the core halves. By integrating the gaps 122, 124 in a single core structure 100 by virtue of the monolithic body 102, multiple core pieces are eliminated, together with assembly difficulties and reliability issues of core separation while the component is in use.. Material costs and assembly costs are accordingly reduced with the single core structure 100 compared to conventional core structures.

The bottom surface 112 of the body 102 may be formed with indents or recessed surfaces 130 that define lands for conductors (described below) that are assembled to the core structure 100.

Figure 10:
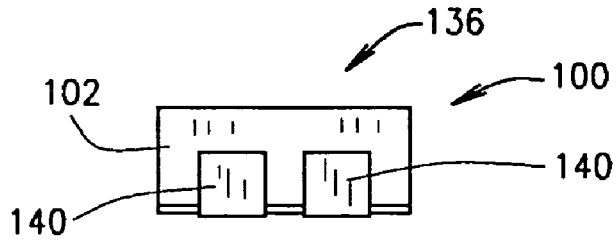
FIG. 10 is a side view of the core structure shown in FIG. 7 with conductors placed therein.
Figure 11:
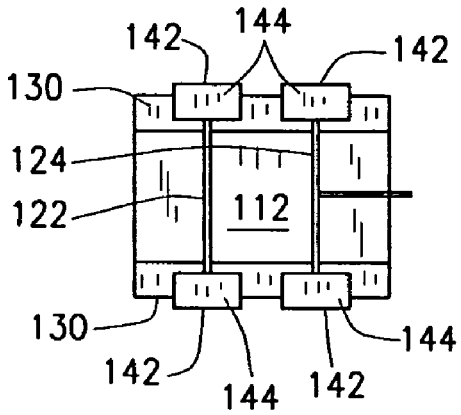
FIG. 11 is a bottom view of the structure shown in FIG. 10.
Figure 12:
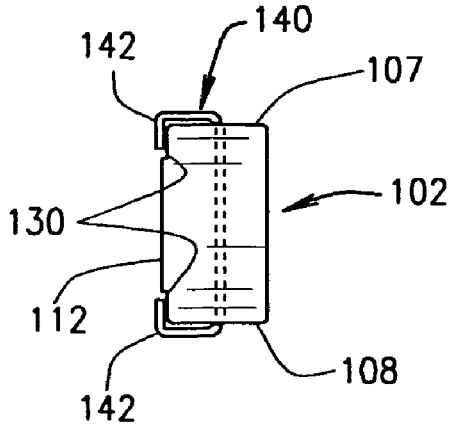
FIG. 12 is a side elevational view of the core structure shown in FIG. 11.
Figure 13:
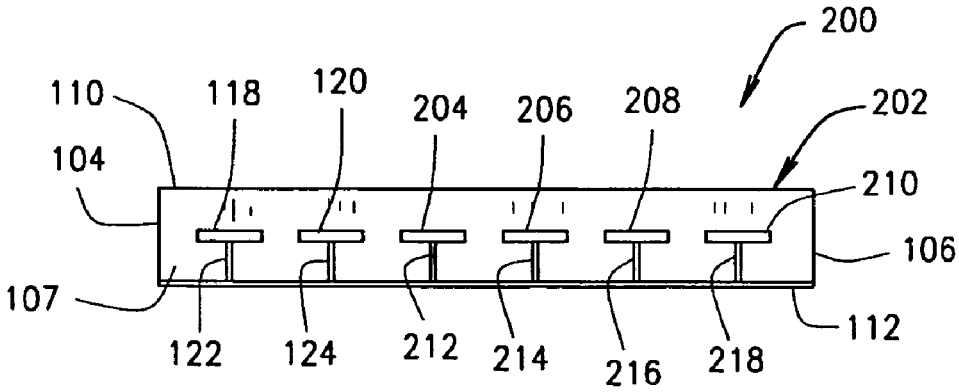
FIG. 13 is a side view of a fifth embodiment of a gapped core structure.
Figure 14:
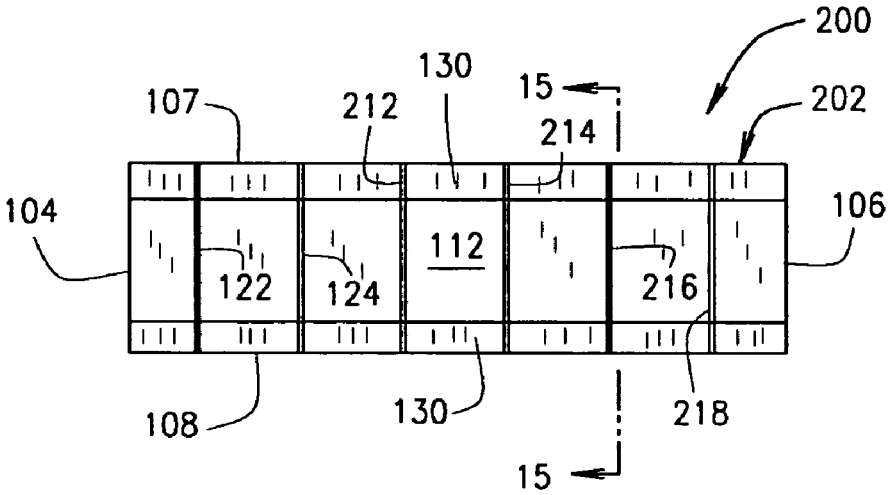
FIG. 14 is a bottom view of the core shown in FIG. 13.
Figure 15:
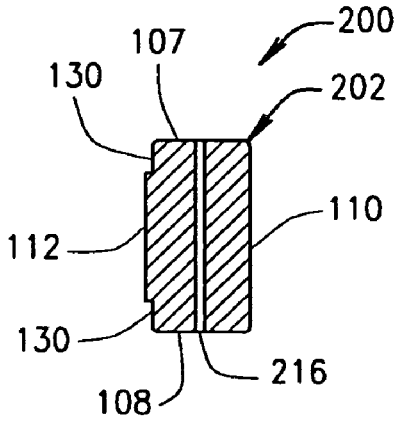
FIG. 15 is a cross sectional view of the core shown in FIG. 14.
Figure 16:
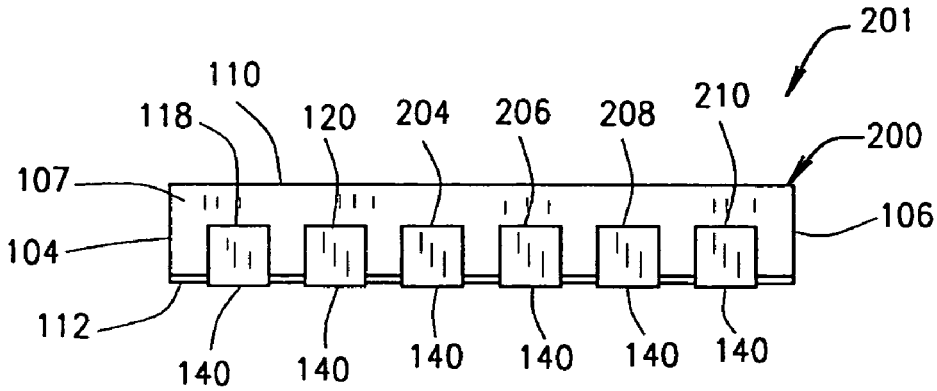
FIG. 16 is a side view of the core structure shown in FIG. 13 with conductors placed therein.
Figure 17:
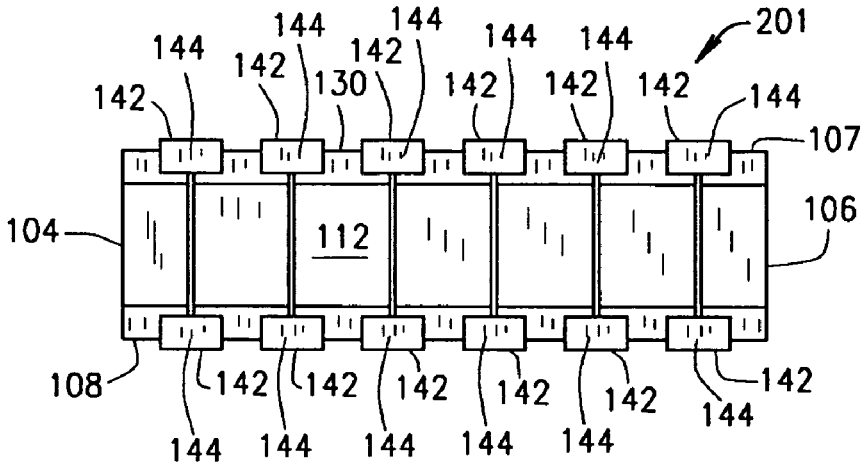
FIG. 17 is a bottom view of the structure shown in FIG. 16.
Figure 18:
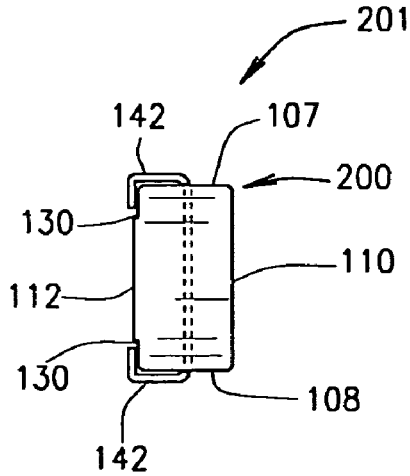
FIG. 18 is a side elevational view of the core structure shown in FIG. 17.

FIGS. 10-12 are like views to FIGS. 7-9 but with conductive elements 140 inserted through the core structure 100, and more specifically through the conductor openings 118, 120 of the body 102 to form a magnetic component 138. The conductive elements 140 are complementary in shape to the conductor openings 118, 120 and may be, for example, generally rectangular and generally flat ribbon conductors fabricated from a known conductive material, such as copper or copper alloy as one example. The conductive elements 140 extend generally linearly through the respective conductor openings 118, 120 for the entire distance between the side edges 107, 108 of the body 102 as best seen in FIG. 12, and opposing ends 142 of each element 140 wrap around the side edged 107, 108 and abut the recesses 130 formed in the bottom surface 112 of the body 102. The ends 142 of the conductive elements 140 thereby define rectangular surface mount termination pads 144 on the bottom surface 112 of the body 102. When connected to conductive traces on a circuit board (not shown) the termination pads 144 complete the electrical connection through the component.

The conductive elements 140 may be fabricated with a lead frame (not shown) from a flat sheet of conductive material according to known punching, stamping or formation techniques, and the lead frame may be used to simultaneously insert the conductive elements 140 through the body 102 of the core 100. The lead frame may then be trimmed from the conductive elements 140 and the ends 142 of the elements 140 may be bent or otherwise formed into the C-shaped configuration shown in FIG. 12. Assembly of the conductive elements 140 may therefore be accomplished in a minimal amount of time using automated processes and machines.

Once the conductive elements 140 are assembled to the core 100, each conductive element 140 and associated gap 122, 124 may function as separate inductors operating on the single core structure 100. Additionally, each conductive element 140 may be operatively connected to different phases of electrical current, thereby provided a two phase magnetic component contained within a single core structure 100. The single piece core structure 100 provides space savings on a circuit board in comparison to separate inductor components having separate core structures.

A surface mount magnetic component having a single piece gapped core structure 100 is therefore provided that achieves similar benefits to the core structures 30 and 50 described above. The core structure 100 may be provided at reduced manufacturing cost and may be manufactured with increased reliability because core separation issues are eliminated by virtue of the single piece core 100.

FIG. 13-18 illustrate a fifth embodiment of a gapped core structure 200 and magnetic component 201 wherein like features of the core structure 100 are indicated with like reference characters.

It is believe to be evident that the gapped core structure 200 is similar to the gapped core structure 100 but has an increased number of conductor openings, associated gaps, and conductive elements. That is, the body 202 of the core structure 100 includes, in addition to the conductor openings 118 and 120, four additional conductor openings 204, 206, 208 and 210. Likewise, in addition to the gaps 122, 124, the body 202 includes discrete gaps 212, 214, 216 and 218 that are formed in a substantially similar manner and orientation as the gaps 122 and 124 described above. When the conductive elements 140 are inserted through the conductor openings in the body 202 and are formed into the C-shaped configuration seen in FIG. 18, the conductive elements 140 and respective gaps 122, 124, 212, 214, 216, and 218 are functional as six different surface mount inductor components integrated into a single core structure 200. Each conductive element 140 may be connected, via surface mount terminations, to conductive traces on a circuit board to operatively connect the conductive elements 140 to six different phases of current while providing substantial space savings on the circuit board. The core structure 200 otherwise provides the same benefits as the core structure 100.

The core structures 100 and 200 are believe to be particularly well suited for application in a multiple voltage regulator module (VRM) that is frequently used in high performance, higher current applications. It is contemplated, however, that other applications would benefit from the core structures 100 and 200, and the invention is not considered to be limited to any particular end use or application.

One embodiment of a magnetic component is described herein that comprises a monolithic core structure fabricated from a magnetic material into a substantially rectangular body. The body is defined by opposing end faces, opposing side edges extending between the end faces, and top and bottom surfaces interconnecting the side edges and the end faces. A first conductor opening is spaced from each of the end faces and the top and bottom surfaces, and the first conductor opening extends entirely through the body. A first gap is integrally formed in the body and extends transverse to the conductor opening. The gap extends incompletely across the body, and a first conductive element establishes a conductive path through the first conductor opening. the first conductive element configured for surface mount termination.

Optionally, the conductive element may comprise a rectangular conductor. A second conductor opening may be formed in the body and spaced from the first conductor opening, a second gap may be formed in the body and extend transverse to the second conductor opening, and a second conductive element may establish an electrical path through the second conductor opening. The first gap extends to the first conductor opening and the first gap and the first conductor opening may be arranged in a T-shaped configuration. The body may be defined by a longitudinal axis and a lateral axis, with the first conductor opening and the first gap extending generally parallel to the lateral axis, and the first conductor opening and the first gap extending generally perpendicular to one another. The bottom surface comprising opposed recessed surfaces, and the first conductive element may wrap around the opposed faces and the recessed surfaces. The gap is formed without utilizing a spacer element fabricated from a non-magnetic material.

An embodiment of a core assembly for a surface electronic component is also described herein. The core assembly comprises a core comprising a monolithic body of uniformly magnetic material, a plurality of conductor openings formed in the core wherein each of the plurality of conductor openings are spaced from one another, and a plurality of gaps integrally formed in the core structure without utilizing insulating spacer materials. Each of the gaps is associated with a respective one of the conductor openings, and each of the gaps extends incompletely across the body.

An embodiment of a surface mount electronic component is described herein. The component comprises a singular core comprising a body uniformly fabricated from a magnetic material, the body having a longitudinal axis and a lateral axis. A plurality of conductor openings are formed in the core and extend parallel to the lateral axis, the plurality of conductor openings spaced from one another along the longitudinal axis. A plurality of non-magnetic gaps are physically formed in the core structure adjacent the respective conductor openings, and the magnetic gaps are formed without utilizing insulating materials applied to the body. A conductive element is located in each of the conductor openings, and the gaps are located adjacent the conductive elements, thereby forming a multi-phase electronic component in the singular core.

Optionally, the core structure comprises two conductor openings. Alternatively, the core structure comprises six conductor openings. The gaps may extend solely between one of the conductor openings and one of the side edges. The component may be an inductor.

An embodiment of a magnetic component is also described. The components comprises a single piece core structure uniformly fabricated from a magnetic material into a body having a non-toroid shape, the body have opposing side surfaces. A first conductor opening extends entirely between the opposing side surfaces and is internally located at a spaced location from a periphery of each of the side surfaces. A gap is formed integrally into the body without utilizing external gapping materials applied to the body, the gap having first and second ends, the first end terminating at and opening to the first conductor opening, and the second end extending to the periphery. Optionally, the component further comprises a second conductor opening and a second gap.

A magnetic component is also described herein. The component comprises a singular core structure monolithically fabricated from a uniform magnetic material into a body having opposing side surfaces. A first conductor opening extends entirely between the opposing side surfaces and is internally located at a spaced location from a periphery of each of the side surfaces. A first gap formed integrally into the body without utilizing external gapping materials applied to the body, the gap having first and second ends, the first end terminating at and opening to the first conductor opening, and the second end extending to the periphery. A C-shaped conductive element extends linearly through the opening, the conductive element having opposing ends, the opposing ends wrapped around the side surfaces to define surface mount terminations for the component. Optionally, the component further comprises a second conductor opening and a second gap, and the component is an inductor.

While the invention has been described in terms of various specific embodiments, those skilled in the art will recognize that the invention can be practiced with modification within the spirit and scope of the claims.

What is claimed is:

1. A magnetic component comprising:

a monolithic core structure fabricated from a magnetic material into a substantially rectangular body, the body being defined by opposing end faces, opposing side edges extending between the end faces, and top and bottom surfaces interconnecting the side edges and the end faces;

a first conductor opening spaced from each of the end faces and the top and bottom surfaces, the first conductor opening extending entirely through the body;

a first gap integrally formed in the body and extending transverse to the conductor opening, the gap extending incompletely across the body; and a first conductive element establishing a conductive path through the first conductor opening, the first conductive element configured for surface mount termination.

2. A magnetic component in accordance with claim 1 wherein the conductive element comprises a rectangular conductor.

3. A magnetic component in accordance with claim 1, further comprising a second conductor opening formed in the body and spaced from the first conductor opening, a second gap formed in the body and extending transverse to the second conductor opening, and a second conductive element establishing an electrical path through the second conductor opening.

4. A magnetic component in accordance with claim 1 wherein the first gap extends to the first conductor opening.

5. A magnetic component in accordance with claim 1, wherein the first gap and the first conductor opening are arranged in a T-shaped configuration.

6. A magnetic component in accordance with claim 1, wherein the body is defined by a longitudinal axis and a lateral axis, the first conductor opening and the first gap extending generally parallel to the lateral axis, the first conductor opening and the first gap extending generally perpendicular to one another.

7. A magnetic component in accordance with claim 1, wherein the bottom surface comprises opposed recessed surfaces, the first conductive element wrapping around the opposed faces and the recessed surfaces.

8. A magnetic component in accordance with claim 1 wherein the conductive element is complementary in shape to the opening.

9. A magnetic component in accordance with claim 1, wherein the gap is formed without utilizing a spacer element fabricated from a non-magnetic material.

10. A core assembly for a surface electronic component, the core assembly comprising:

a core comprising a monolithic body of uniformly magnetic material, a plurality of conductor openings formed in the core wherein each of the plurality of conductor openings are spaced from one another, and a plurality of gaps integrally formed in the core structure without utilizing insulating spacer materials, wherein each of the gaps is associated with a respective one of the conductor openings, and each of the gaps extends incompletely across the body.

11. A core assembly in accordance with claim 10, further comprising conductive elements in each respective conductor opening.

12. A core assembly in accordance with claim 10, wherein each of the gaps extends substantially perpendicular to the respective conductor openings.

13. A core assembly in accordance with claim 10, wherein the conductor openings are substantially rectangular.

14. A core assembly in accordance with claim 10, wherein each of the gaps is in communication with the respective conductor openings.

15. A core assembly in accordance with claim 10, wherein each of the conductor openings and the associated gaps are arranged in a T configuration.

16. A core assembly in accordance with claim 10, wherein the gaps extend transverse to the conductor openings.

17. A surface mount electronic component comprising:

a singular core comprising a body uniformly fabricated from a magnetic material, the body having a longitudinal axis and a lateral axis;

a plurality of conductor openings formed in the core and extending parallel to the lateral axis, the plurality of conductor openings spaced from one another along the longitudinal axis;

a plurality of non-magnetic gaps physically formed in the core structure adjacent the respective conductor openings, the magnetic gaps formed without utilizing insulating materials applied to the body; and a conductive element located in each of the conductor openings, the gaps being located adjacent the conductive elements, thereby forming a multi-phase electronic component in the singular core.

18. An electronic component in accordance with claim 17, wherein the core structure comprises two conductor openings.

19. An electronic component in accordance with claim 17, wherein the core structure comprises six conductor openings.

20. An electronic component in accordance with claim 17, wherein the gaps extend transverse to the respective conductive openings.

21. An electronic component in accordance with claim 17, wherein each of the gaps is in communication with one of the conductor openings.

22. An electronic component in accordance with claim 17, wherein the conductor openings are substantially rectangular.

23. An electronic component in accordance with claim 17, wherein the gaps are arranged in a T-configuration with the conductor openings.

24. An electronic component in accordance with claim 17, wherein the body is substantially rectangular.

25. An electronic component in accordance with claim 17, wherein the gaps extend solely between one of the conductor openings and one of the side edges.

26. An electronic component in accordance with claim 17, wherein the component is an inductor.

27. A magnetic component comprising:

a single piece core structure uniformly fabricated from a magnetic material into a body having a non-toroid shape, the body have opposing side surfaces;

a first conductor opening extending entirely between the opposing side surfaces and internally located at a spaced location from a periphery of each of the side surfaces; and a gap formed integrally into the body without utilizing external gapping materials applied to the body, the gap having first and second ends, the first end terminating at and opening to the first conductor opening, and the second end extending to the periphery.

28. A magnetic component in accordance with claim 27, further comprising a second conductor opening and a second gap.

29. A magnetic component in accordance with claim 27, further comprising a rectangular conductor inserted through the first conductor opening and wrapping around the side surfaces.

30. A magnetic component comprising:

a singular core structure monolithically fabricated from a uniform magnetic material into a body having opposing side surfaces;

a first conductor opening extending entirely between the opposing side surfaces and internally located at a spaced location from a periphery of each of the side surfaces;

a first gap formed integrally into the body without utilizing external gapping materials applied to the body, the gap having first and second ends, the first end terminating at and opening to the first conductor opening, and the second end extending to the periphery; and a C-shaped conductive element extending linearly through the opening, the conductive element having opposing ends, the opposing ends wrapped around the side surfaces to define surface mount terminations for the component.

31. A magnetic component in accordance with claim 30, further comprising a second conductor opening and a second gap.

32. A magnetic component in accordance with claim 30, wherein the component is an inductor.

* * * * *